US006983120B2

(12) United States Patent
Ishii et al.

(10) Patent No.: US 6,983,120 B2
(45) Date of Patent: Jan. 3, 2006

(54) CLEANING BLADE, CLEANING DEVICE, PROCESS CARTRIDGE, AND IMAGE FORMING APPARATUS USING THEM

(75) Inventors: Yasuyuki Ishii, Shizuoka (JP); Masato Koyanagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 10/765,856

(22) Filed: Jan. 29, 2004

(65) Prior Publication Data

US 2004/0213607 A1 Oct. 28, 2004

(30) Foreign Application Priority Data

Jan. 31, 2003 (JP) ..... 2003-023428
May 30, 2003 (JP) ..... 2003-155216
Jan. 23, 2004 (JP) ..... 2004-015603

(51) Int. Cl.
*G03G 21/00* (2006.01)

(52) U.S. Cl. ..... 399/346; 399/350

(58) Field of Classification Search ..... 399/346, 399/343

See application file for complete search history.

(56) References Cited

U.S. PATENT DOCUMENTS 3,717,409 A * 2/1973 Hespenheide ..... 399/359
5,321,482 A * 6/1994 Yano et al. ..... 399/346
5,646,718 A * 7/1997 Suwa et al. ..... 399/350
5,819,147 A 10/1998 Shoji ..... 399/284
5,835,818 A 11/1998 Hoshika et al. ..... 399/26
5,995,785 A * 11/1999 Kato et al. ..... 399/350 X
6,529,699 B2 3/2003 Ishii et al. ..... 399/159
6,577,823 B2 6/2003 Matsuguma et al. ..... 399/26
2002/0031384 A1 * 3/2002 Sato ..... 399/346
2004/0121162 A1 * 6/2004 Yamaoka et al. ..... 428/425.8

FOREIGN PATENT DOCUMENTS

JP 06-035385 A * 2/1994

* cited by examiner

*Primary Examiner*—Sophia S. Chen
(74) *Attorney, Agent, or Firm*—Fitzpatrick, Cella, Harper & Scinto

(57) ABSTRACT

A plurality of cleaning blades are provided for removing remaining developer on an electrophotographic photosensitive body used for an image forming apparatus. The cleaning blades include an abutment portion that abuts on the electrophotographic photosensitive body, and lubricant including insulating particles and conductive particles coating the abutment portion. The particle size of each of the insulating particles at D50 by a volume regarded as a reference lies in a range of 0.2 to 1.0 μm and the particle size of each of the conductive particles at D50 by a volume regarded as a reference lies in a range of 0.4 to 4.0 μm, D50 being defined by the integration of volumes of particles calculated from a smaller particle size side that reaches 50% relative to a total integration thereof.

23 Claims, 7 Drawing Sheets

*FIG. 4*

CASE WHERE REDUCTION-PROCESSED TYPE TIN OXIDE HAVING RESISTANCE THAT IS NOT MORE THAN $10^5$ Ωcm

| TOSPEARL (wt%) | TIN OXIDE (wt%) | LUBRICANT ADHESIVENESS | BLADE DETATCHMENT |
|---|---|---|---|
| 100 | 0 | × | ○ |
| 90 | 10 | × | ○ |
| 80 | 20 | ◎ | ○ |
| 70 | 30 | ◎ | ○ |
| 60 | 40 | ◎ | ○ |
| 50 | 50 | ◎ | ○ |
| 40 | 60 | ○ | ○ |
| 30 | 70 | ○ | ○ |
| 20 | 80 | ○ | ○ |
| 10 | 90 | ○ | × |
| 0 | 100 | ○ | × |

*FIG. 7*

CASE WHERE REDUCTION-PROCESSED TYPE TIN OXIDE HAVING RESISTANCE THAT IS NOT MORE THAN $10^6$ Ω·cm

| TOSPEARL (wt%) | TIN OXIDE (wt%) | LUBRICANT ADHESIVENESS | BLADE DETATCHMENT |
|---|---|---|---|
| 100 | 0 | × | ○ |
| 90 | 10 | × | ○ |
| 80 | 20 | × | ○ |
| 70 | 30 | × | ○ |
| 60 | 40 | × | ○ |
| 50 | 50 | × | ○ |
| 40 | 60 | △ | ○ |
| 30 | 70 | △ | ○ |
| 20 | 80 | △ | ○ |
| 10 | 90 | △ | × |
| 0 | 100 | △ | × |

CLEANING BLADE, CLEANING DEVICE, PROCESS CARTRIDGE, AND IMAGE FORMING APPARATUS USING THEM

FIELD OF THE INVENTION AND RELATED ART

The present invention relates to an image forming apparatus, a process cartridge, a cleaning device, and a cleaning blade used for the image forming apparatus.

The "image forming apparatus" is defined as an apparatus for forming an image onto a recording medium using an electrophotographic image forming process, and for example includes an electrophotographic copier, an electrophotographic printer such as a laser printer and LED printer), a facsimile machine, a word processor, and so on.

Also the "process cartridge" is defined as a cartridge that is detachably attached to a body of the image forming apparatus, allowing an electrophotographic photosensitive body and the cleaning device for cleaning the electrophotographic photosensitive body to be integrally accommodated in the cartridge.

Also the "cleaning device" is defined as a device having the cleaning blade for removing a remaining developer on the electrically photosensitive body and a developing reception part in which the developer removed by the cleaning blade is received.

Recently a conductive roller contact charging method is realized. Its advantages are that this method does not need a large power supply because of a low voltage activation, and does not especially need a cleaning unit for a charging device.

The conductive roller contact charging method is a method that a conductive charging member is made to be abutted on an object to be charged and thus a voltage is applied thereto, by which discharging is performed in a gap between the charging member and the object to be charged, resulting in the required charging potential on the object to be charged.

There are an AC charging method and a DC charging method as the contact charging method. The AC charging method allows a charging condition to be created by applying a voltage obtained by superposing a DC current corresponding to a charging potential with an AC voltage thereto. The DC charging method allows a charging condition to be created by applying a voltage obtained by adding a charging potential to a discharging start-voltage thereto.

Next an explanation will be provided about a conventional cleaning device. Generally speaking, in the conventional cleaning device used for an electrophotographic image forming apparatus, a cleaning roller is rotated, abutting on a photosensitive body, or a cleaning blade as a cleaning member is abutted thereon, resulting in the remaining toner (developer) that not been transferred being scratched off, thus removing such remaining toner from the photosensitive body.

Especially in an electrophotographic image forming apparatus of the process cartridge type, in view of the advantage that its construction is simple and its cost is not expensive, etc., a cleaning blade made of urethane rubber is often used when pressing and abutting on a photosensitive body in a counter direction of the photosensitive body.

However, in the case where the cleaning blade is used, if a frictional force becomes large while the cleaning blade is sliding on the photosensitive body, then a "blade-detachment" phenomenon will occur such that the cleaning blade is turned over.

There are few cases where blade-detachment occurs because toner functions as a lubricant in a state where the toner exists on an edge of the cleaning blade. However, in the initial period in which the main body or the process cartridge is used, the toner does not exist on the edge of the cleaning blade, resulting in an increase of the frequency of occurrence of blade detachment.

Therefore, conventionally in such an initial period of use powder is coated on an edge of a cleaning blade thereby adopting a method in which friction between a photosensitive body in the initial state and the cleaning blade can be reduced.

The following properties for such powder are required. The powder has an effective particle-size for prevention of blade-detachment and is easy to be dispersed into solvent upon coating and has a splendid anti-solvent characteristic. Thus, powder made of insulating silicone resin fine power, whose trade name is "Tospearl" produced by GE TOSHIBA SILICONE Co.) is mainly used. The particle size of the silicone resin fine powder is 0.2 to 1.0 $\mu$m.

HFE (hydrofluoroether) having a splendid dispersing and coating property is used as a solvent when the above-mentioned silicone resin fine powder is coated on an edge of a cleaning blade. Therefore, the silicone resin fine powder is widely used as a coating agent for the cleaning blade because the silicone resin fine powder is not dissolved by HFE (refer to U.S. Pat. No. 5,819,147).

However, when such a silicone resin fine powder is coated on the cleaning blade as a cleaning member abutting on a photosensitive body using the above-mentioned contact charging method type charging device because of the restriction on the construction of an electrophotographic image forming apparatus, a contact charging member needs to be arranged at a downstream side rather than the cleaning blade in the apparatus and also in a direction of motion of the photosensitive body.

As a result, there has been the problem that the silicone resin powder which has passed through under the cleaning blade and which has been extraordinarily coated on the cleaning blade will be attached to a contact charging member at the downstream side.

SUMMARY OF THE INVENTION

An object of the present invention is to provide a cleaning blade, a cleaning device, a process cartridge, and an image forming apparatus using them, which can prevent the cleaning blade from being detached by motion of an electrophotographic photosensitive body.

Also, another object of the present invention is to provide a cleaning blade, a cleaning device, a process cartridge, and an image forming apparatus using them, in which adhesiveness is enhanced between the cleaning blade and insulating particles that are coated on an abutment portion of the cleaning blade and the abutment portion is a portion that abuts on the electrophotographic photosensitive body.

Also, another object of the present invention is to provide a cleaning blade, a cleaning device, a process cartridge, and an image forming apparatus using them, which can prevent that an electrophotographic photosensitive body from being insufficiently charged by a charging roller by attaching insulating particles coated on an abutment portion of the cleaning blade that abuts on the electrophotographic photosensitive body, to the electrophotographic photosensitive body.

Also, another object of the present invention is to provide a cleaning blade including an abutment portion of the cleaning blade that abuts on an electrophotographic photosensitive body, and lubricant including insulating particles and conductive particles coated on the abutment portion. The medium volume-based particle size D50, of each of the insulating particles lies in a range of 0.2 to 1.0 μm and the medium volume-based particle size D50, of each of the conductive particles lies in a range of 0.4 to 4.0 μm, D50 being defined by the integration of volumes of particles calculated from a smaller particles size side that arrives at 50% relative to a total integration thereof.

Also, another object of the present invention is to provide a cleaning device used for an image forming apparatus that comprises: a cleaning blade for removing the remaining developer on the electrophotographic photosensitive body; an abutment portion that abuts on the electrophotographic photosensitive body, and lubricant including insulating particles and conductive particles coated on the abutment portion. The medium volume-based particle size, D50, of each of the insulating particles lies in a range of 0.2 to 1.0 μm and the medium volume-based particle size, D50, of each of the conductive particles lies in a range of 0.4 to 4.0 μm, D50 being defined by the integration of volumes of particles calculated from a smaller particles size side that arrives at 50% relative to a total integration thereof.

Also another object of the present invention is to provide a process cartridge attachable to a body of an image forming apparatus that comprises: an electrophotographic photosensitive body; a charging means for working on the electrophotographic photosensitive body; a cleaning blade for removing the remaining developer on the electrophotographic photosensitive body; an abutment portion that abuts on the electrophotographic photosensitive body, and lubricant including insulating particles and conductive particles coated on the abutment portion. The medium volume-based particle size, D50, of each of the insulating particles lies in a range of 0.2 to 1.0 μm and the medium volume-based particle size, D50, of each of the conductive particles lies in a range of 0.4 to 4.0 m, D50 being defined by the integration of volumes of particles calculated from a smaller particles size side that arrives at 50% relative to a total integration thereof.

Also another object of the present invention is to provide an image forming apparatus for forming an image on a recording medium that comprises: (i) a cleaning device used for the image forming apparatus having a cleaning blade for removing the remaining developer on the electrophotographic photosensitive body; an abutment portion that abuts on the electrophotographic photosensitive body, and lubricant including insulating particles and conductive particles coated on the abutment portion. The medium volume-based particle size, D50, of each of the insulating particles lies in a range of 0.2 to 1.0 μm and the medium volume-based particle size, D50, of each of the conductive particles lies in a range of 0.4 to 4.0 μm, D50 being defined by the integration of volumes of particles calculated from a smaller particles size side that arrives at 50% relative to a total integration thereof; and (ii) carrying means for carrying the recording medium.

Also another object of the present invention is to provide an image formation apparatus for forming an image onto a recording medium to which a process cartridge is attachable that comprises: (i) an attachment portion detachably attached to the process cartridge; (ii) the process cartridge attached to the attachment portion that includes an electrophotographic photosensitive body; a charging means for working on the electrophotographic photosensitive body; a cleaning blade for removing the remaining developer on the electrophotographic photosensitive body; an abutment portion that abuts on the electrophotographic photosensitive body, and lubricant including insulating particles and conductive particles coated on the abutment portion, where the medium volume-based particle size, D50, of each of the insulating particles lies in a range of 0.2 to 1.0 μm and the medium volume-based particle size, D50, of each of the conductive particles lies in a range of 0.4 to 4.0 μm, where D50 is defined by the integration of volumes of particles calculated from a smaller particles size side that arrives at 50% relative to a total integration thereof; and (iii) carrying means for carrying the recording medium.

BRIEF DESCRIPTION OF DRAWINGS

FIG. 4 is a table showing the relationship between adhesiveness of lubricant and the detachment of the cleaning blade upon blending of a reduction-process type tin oxide having a value of resistance being not more than $10^5$ Ωcm relating to the present embodiment.

FIG. 7 is a table showing the relationship between adhesiveness of lubricant and the detachment of the cleaning blade upon blending of a reduction-process type tin oxide having a value of resistance being not more than $10^5$ Ωcm, in comparison with the present invention relating to the present embodiment.

DETAILED DESCRIPTION OF THE PREFERRED EMBODIMENTS

Figure 1:
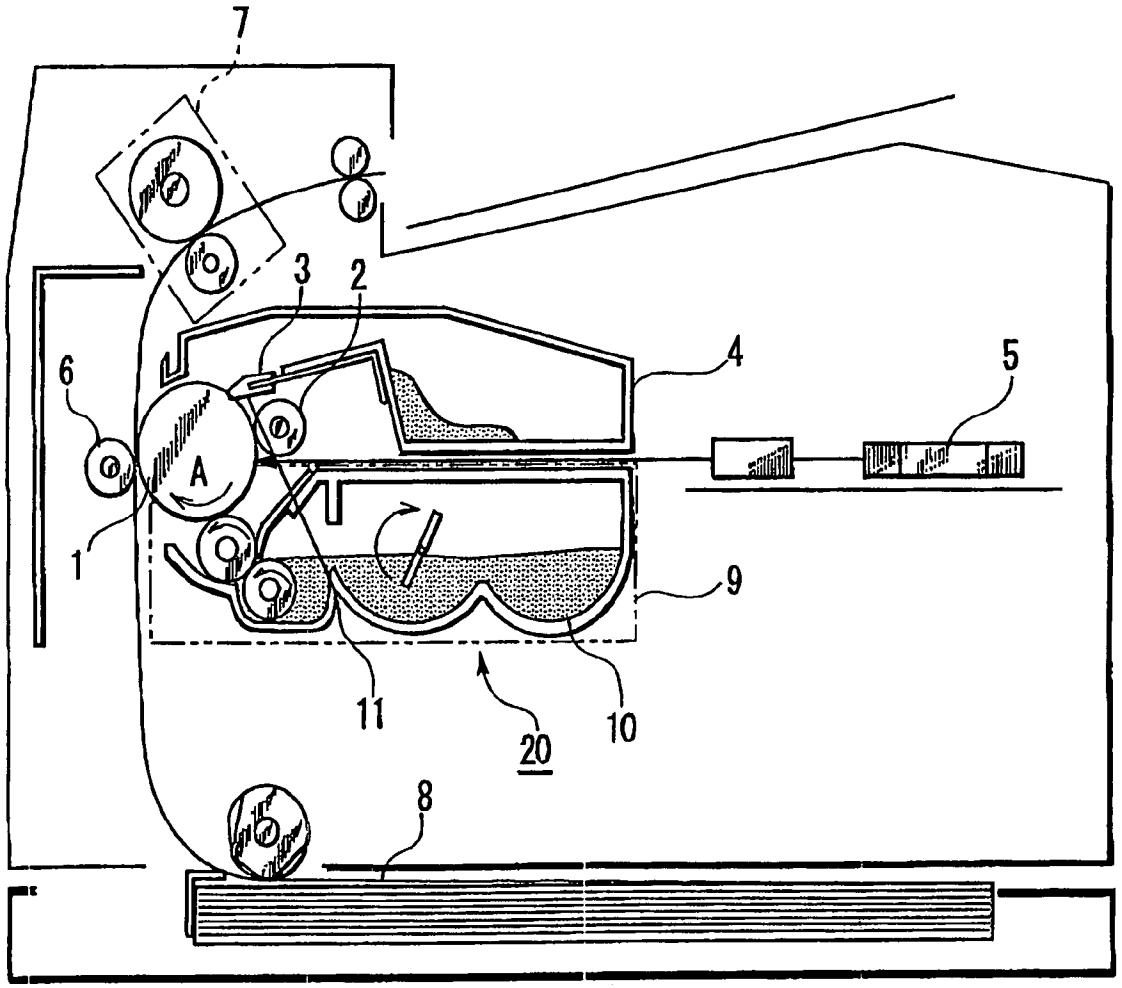
FIG. 1 is a schematic section of an image forming apparatus relating of the present embodiment.

Hereinafter the preferred embodiments of the present invention will be explained illustratively in detail, referring to the drawings. However, the scope of the present invention is not merely limited by dimension, material, shape, and relative arrangement described in this preferred embodiments as long as there is no especially specific description.

FIG. 1 is a schematic section of an image forming apparatus relating of the present embodiment. The entire configuration of the image forming apparatus of the present embodiment will be explained using FIG. 1.

In FIG. 1, a photosensitive drum 1 (Φ 30 mm) is rotated at 1 r.p.s. in an arrow A direction. The photosensitive drum 1 is evenly charged at a dark potential −600 V by a charging roller 2 as a charging means to which a D.C. voltage of −1150 V is applied.

And an electrostatic latent image is written onto the photosensitive drum 1 with a laser beam to be introduced from a laser scanner 5 as an exposure means. The laser power of the laser beam introduced from the laser scanner 5 is adjusted so as to have −150V when the laser beam is exposed over a whole surface.

The laser scanner 5 is inputted to the image forming apparatus. A laser beam that has been ON/OFF-controlled according to an image signal to be produced within an inside of a main body of the apparatus such as a test pattern, irradiates the photosensitive drum 1, and an electrostatic latent image is formed on the photosensitive drum 1.

Such an electrostatic latent image is developed using toner 10 by a developing device 9 as a developing means arranged in the vicinity of the photosensitive drum 1, resulting in the electrostatic latent image becoming visible as a toner image. Note that in the present embodiment, so to speak, a reversal development is performed for forming the toner image at an exposure part exposed by the laser beam.

The toner image that has been visible on the photosensitive drum 1 is transferred to the recording medium 8 by a transfer roller 6 as a transfer means.

Also a fixing device 7 as a fixing means at a downstream side of the apparatus fixes a recording medium on which the toner image has been transferred.

Here, the remaining and transferred toner on the photosensitive drum 1 that has not been transferred is scratched by a cleaning blade 3 as a cleaning member of the cleaning device 4 and accommodated within the cleaning device 4. And the photosensitive drum 1 that has been cleaned repeats the above-mentioned image forming process. A tip part of the cleaning blade 3 used here is rectangular, and the thickness at a base side of the cleaning blade 3 is thicker than that at the tip part side thereof.

Note that in the present embodiments, the process cartridge method is used in which the above-mentioned photosensitive drum 1, the charging roller 2, the developing device 9, and the cleaning device 4 are integrally formed, resulting in a process cartridge 20 comprising the integrally formed configuration, which can be attachable to and detachable from the image forming apparatus.

Because this process cartridge method is adopted, maintenance of the image forming apparatus becomes easy. Namely, when toner becomes empty in the developing device 9, the photosensitive drum 1 and the charging roller 2 can be replaced together. Also the transferred and remaining toner built up in the cleaning device 4 can be simultaneously discarded. As a result, a user of the image forming apparatus has only to replace the process cartridge 20 with a new one and thus can perform simultaneously various processes together, resulting in easy maintenance and the continuous production of a splendid image.

Also, because of the process cartridge method, the cleaning blade 3 is simply constituted and the cost can be reduced using a urethane-rubber-made tip blade.

Now, a description will be provided about the cleaning blade 3 in more detail.

Figure 3:
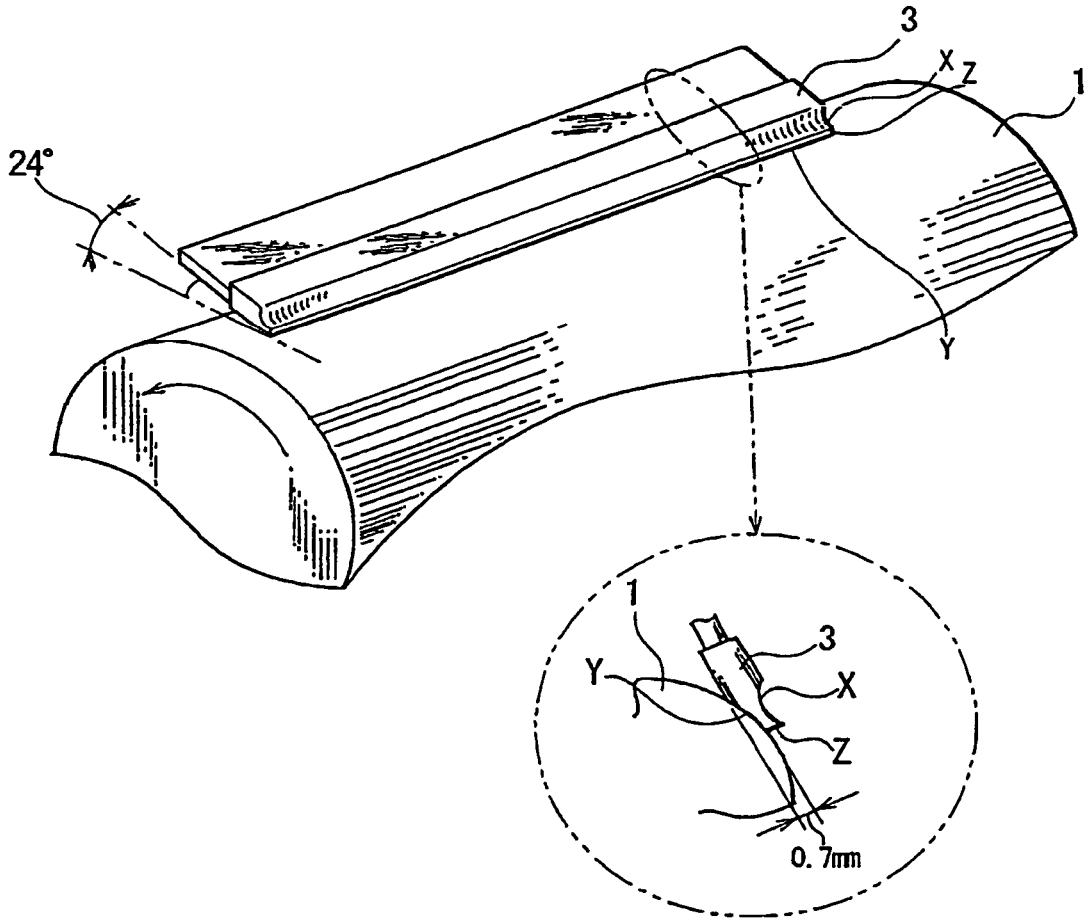
FIG. 3 is an explanatory view illustrating a sliding condition of the cleaning blade against a photosensitive drum relating to the present embodiment.

The cleaning blade 3 is set so that an abutment angle with relative to the photosensitive drum 1 as shown in FIG. 3 is 24 degrees and the amount of intrusion into the photosensitive drum 1 is 0.7 mm. At this time, the linear pressure of the cleaning blade 3 is 35 g/cm.

Thus, according to the above setting, defects in cleaning and the occurrence of detachment of the blade will be prevented while a paper is passing through predetermined portions of the apparatus.

Generally speaking, while a paper is passing through predetermined portions, the toner 10 become placed at an edge portion of the cleaning blade 3 so as to serve as a lubricant, resulting a low frequency of detachment of the blade 3. However at the initial period of use when the toner 10 is not located on the blade 3, the frictional coefficient is great between the cleaning blade 3 and the photosensitive drum 1, resulting in an increase in the possibility of the occurrence of detachment of the blade 3.

Thus, in the present embodiment, a lubricant agent 11 is coated on the abutment portion between the photosensitive drum 1 and the cleaning blade 3. Here, the lubricant agent 11 is made by blending silicone resin fine powder being insulating fine particles (e.g., the above-mentioned Tospearl) and metallic compounds being conductive fine particles.

The metallic compositions are, for example, directed to metallic fine powder such as Cu, Au, Ag, Al, and Ni; and conductive fine powder made of metallic compounds such as zinc oxide, titanium oxide, tin oxide, aluminum oxide, indium oxide, silicon oxide, magnesium oxide, barium oxide, molybdenum oxide, ferric oxide, tungstic oxide and composite oxides using any of them.

Above all, if the metallic composition includes one oxide of at least one kind selected from zinc oxide, tin oxide, and titan oxide, it is preferable because the resistance (volume resistivity) of the metallic composition fine particles can be lower.

Also, in order to control resistance of the metallic composition fine particles and the like, fine particles of metallic oxide including elements such as Antimony and Aluminum are used and fine particles are used, each of whose surface has a conductive material comprising metallic composition fine particles. For example, they are fine particles of zinc oxide including aluminum atoms or fine particles of tin oxide including antimony atoms.

Then, in the present embodiment, it is more preferable that a reduction-processed type tin oxide is used as the metallic composition fine particles. That's why resistance of the reduction-processed type tin oxide can be controlled.

Thus, therein, the lubricant agent 11 is used, in which silicone resin fine powder being insulating fine particles (e.g. the above-mentioned Tospearl) and metallic composition fine particles are blended. And by using the lubricant agent 11, it becomes possible to prevent detachment of the cleaning blade 3 and to enhance the adhesion strength between the cleaning blade 3 and coating agent.

In the present embodiment, Tospearl and the reduction-processed type tin oxide are concretely used as the lubricant agent 11. Hereinafter, a description will be provided about this case.

The median volume-based size (diameter) (D50) of Tospearl particles is 0.2 to 1.0 $\mu$m while the median volume-based size (D50) of the reduction-processed type tin oxide is 0.4 to 4.0 $\mu$m.

D10, D50, and D90 of Tospearl particles and metallic composition fine particles are measured as follows.

A liquid module is mounted to a laser diffraction type particle distribution measurement apparatus "LS-230 type" (produced by COULTER Co.), in which the measurement range is defined by a particle size range of 0.04 to 2000 $\mu$m and D10, D50, and D90 of particles to be measured are calculated by a particle distribution to be obtained by volume reference. After particles whose weight is about 10 mg are added to 10 ml of methanol, an ultrasonic distributor disperses this solvent for two minutes, measurement is once repeatedly performed for 90 minutes. Here, D10, D50 and D90 are respectively defined by the integration of volumes of particles calculated from a smaller particles size side that arrives at 10%, 50%, and 90% relative to a total integration thereof.

Figure 2:
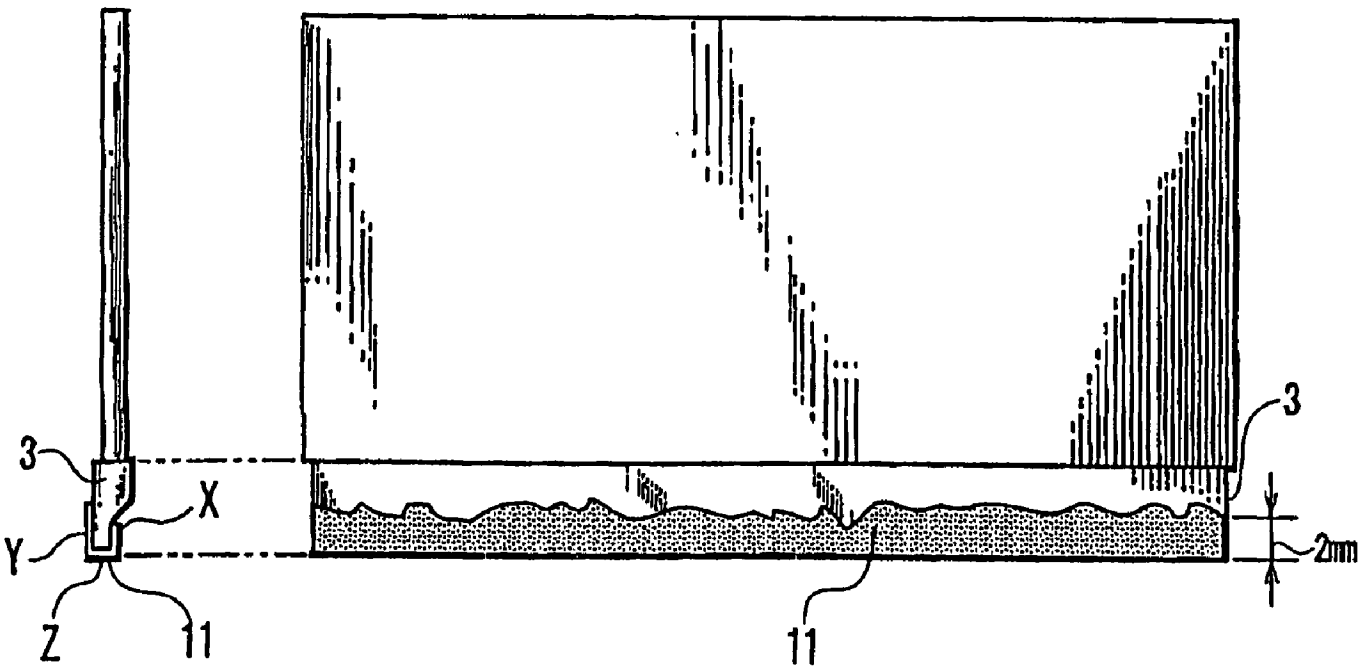
FIG. 2 is an explanatory view of a cleaning blade relating to the present embodiment.

In a method of coating the lubricant agent 11 onto the cleaning blade 3, Tospearl particles and reduction-processed type tin oxide particles are blended into HFE and dispersed thereinto by a ratio of 5% relative to the total amount. This blending and dispersed one is coated on an edge of the cleaning blade 3 at substantially 2 mm width as shown in FIG. 2. Namely, the blending and dispersed one is coated on a lateral portion Z perpendicularly connected to both flat portions X and Y being mutually opposed and the flat portions X and Y.

The adhesive strength between the cleaning blade 3 and the lubricant agent 11 can be enhanced and detachment of the blade 3 can be prevented by coating the lubricant agent 11 thereon. Namely, it is prevented that the insulating Tospearl particles are electrostatically agglutinated by the existence of particles of reduction-processed tin oxide of a certain size. Therefore, under this condition, particles of Tospearl are not electrostatically agglutinated, namely not enlarged, so that the particles of Tospearl do not drop off and lubricity of the blade 3 is maintained. If the size of the reduction-processed type tin oxide particles are respectively below a range of 0.4 to 4.0 μm, the Tospearl particles will be easy to electrostatically agglutinate. On the other hand, if the size of the reduction-processed type tin oxide particles is respectively above a range of 0.4 to 4.0 μm, there will be no effect of lubricity. Especially, if the volume-based particle size, D50, of the reduction-processed type tin oxide particles is larger than the volume-based particle size, D50, of Tospearl, the electrostatic aggregation prevention effect is great. That's why it becomes difficult for Tospearl particles to move, so that Tospearl particles cannot be electrostatically agglutinated because the particle size of each of the reduction-processed type tin oxide particles is larger than that of Tospearl particles. As a preferable specific range, the volume-based particle size, D50, of particles of Tospearl lies in a range of 0.6 to 0.8 μm and the volume-based particle size, D50, of the reduction-processed type tin oxide particles lies in a range of 1.0 to 2.0 μm.

Also it is preferable that a proper surface treatment is applied to metallic composition fine particles, such as the reduction-processed type tin oxide particles, and that the applied particles are splendidly dispersed into a solvent (such as HFE). For example, as a representative example of such a proper surface treatment for metallic composition fine particles, there is a hydrophobic process. If a processing agent for such a hydrophobic process is made of a silane composition, water-shedding is splendid and most preferable.

A process speed of an electrophotographic type image forming apparatus used in this experiment is 94 mm/sec. Also this apparatus is constituted as shown in FIG. 1, which is above-mentioned.

Here, an OPC drum having a diameter of 30 mm is used as the photosensitive drum 1. On the other hand, the charging roller 2 is made to abut onto the photosensitive drum 1, adding pressure thereto by a total added pressure of 9.8 N using a spring and it is rotated to correspond to the rotation of the photosensitive drum 1. DC voltage of −1150 V is applied to the charging roller 2 so that the roller 2 has −600 v corresponding to a target voltage Vd of the photosensitive body.

Hereinafter, a description will be provided about a ratio of blending of particles of Tospearl of the lubricant agent 11 to the reduction-processed type tin oxide particles.

As shown in FIG. 4, if an additive amount of the reduction-processed type tin oxide particles having resistance not less than 105 cm is 20 to 80% (% by weight:wt %) with relative to a total amount of the lubricant agent 11, the adhesive strength between the cleaning blade 3 and the lubricant agent 11 is enhanced and detachment of the blade 3 can be prevented.

Deterioration of the adhesive strength is caused by aggregation of the lubricant agent 11 after coating. The aggregation allows the lubricant agent 11 to be collected, and the collected lubricant detaches from the cleaning blade 3. Aggregation increases for 72 hours after coating and after that the aggregation becomes constant.

Therefore the reduction-processed type tin oxide particles and Tospearl particles are blended, so that electrostatic aggregation after coating can be prevented and the adhesive strength is enhanced. Accordingly, also in this experiment, 100 sheets of paper were continuously passed through the apparatus for 72 hours after coating, and a condition or detachment of lubricant agent 11 from the cleaning blade 3 was confirmed.

Figure 6:
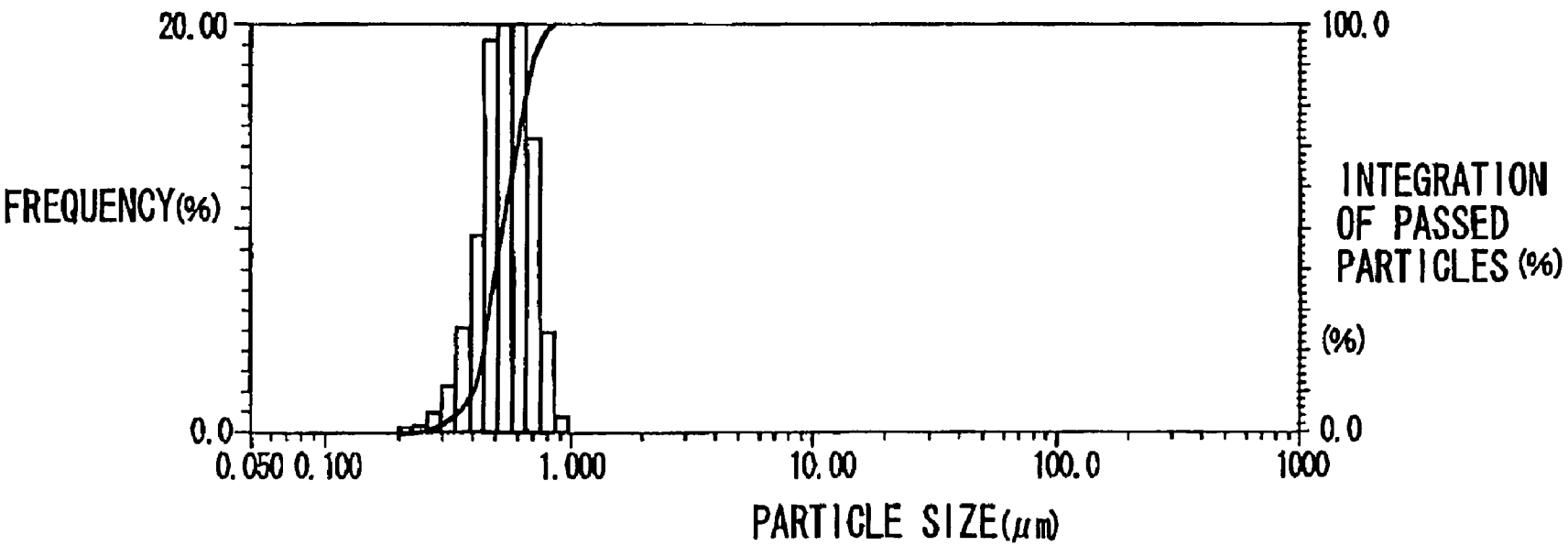
FIG. 6 is a view illustrating the particle distribution after 72 hours have elapsed since the blade coating in a case that the ratio by weight of an additive amount of a reduction-process type tin oxide having a value of resistance being not more than $10^5$ Ωcm to an amount of Tospearl=4 to 6.

A small amount of detachment was recognized, though there is no problem from a point of view of image quality when the additive amount of reduction-processed type tin oxide particles was defined by 50 to 80% (wt %). From this point, there is no practical problem, if the additive amount of reduction-processed type tin oxide particles was defined by 20 to 80% (wt %). On the other hand, it is more preferable that the additive amount of reduction-processed type tin oxide particles was defined by 20 to 50% (wt %) from the point of view of the detachment property of the lubricant agent 11. Particle size distribution in 72 hours after coating if the ratio of an additive amount of the reduction-processed type tin oxide particles having resistance not more than $10^5$ Ωcm to an amount of Tospearl particles is 4 to 6 is shown in FIG. 6.

Figure 5:
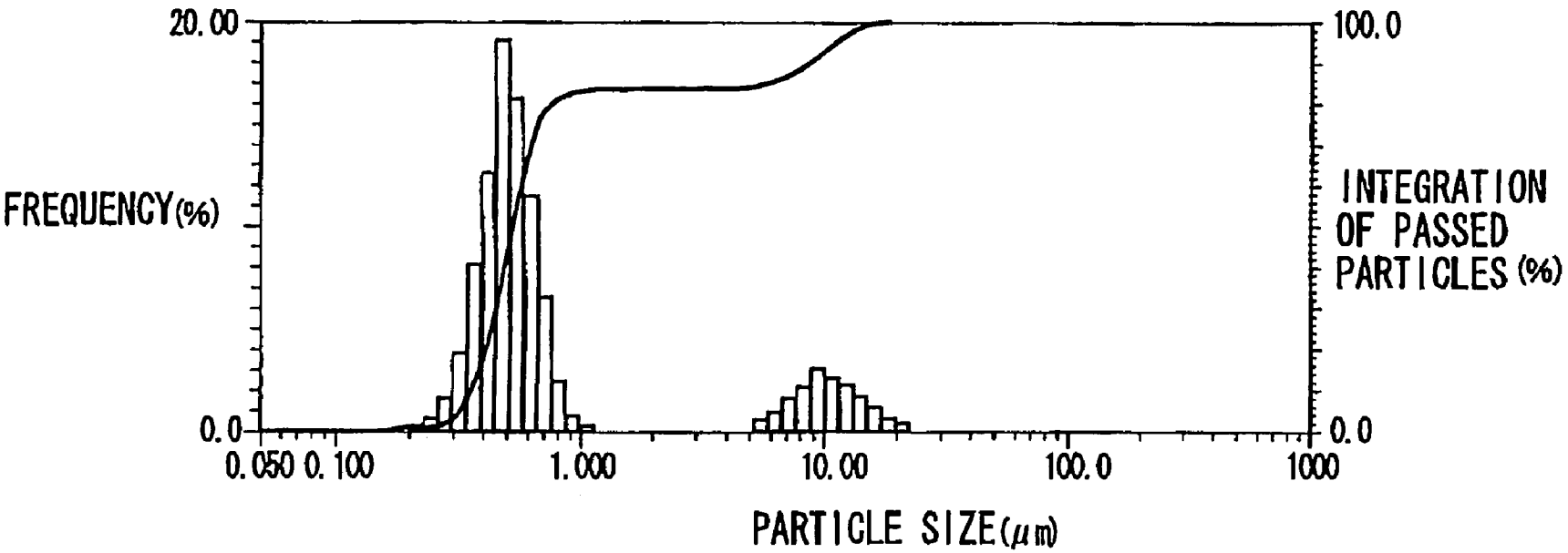
FIG. 5 is a view illustrating a particle distribution after 72 hours have elapsed since only Tospearl is coated on the blade.

Particle size distribution in 72 hours after coating if only Tospearl is coated thereon is shown in FIG. 5. Upon measuring the particle size distribution, a liquid module is mounted to an above-mentioned laser diffraction type particle size distribution measuring apparatus "LS-230 type" (Coulter, Inc.), in which a measuring range of particle sizes is 0.04 to 2000 μm and thus a particle size distribution to be measured is measured by a volume reference.

In the measurement of the particle size distribution by a volume reference, the mass of lubricant agent 11 detached from the cleaning blade 3 is substantially 10 mg and the lubricant agent is added to 10 ml of HFE. After dispersing it, using a distributed machine "US-1 type" (by NND K.K.), measurement is performed under the condition that the measuring time is 90 seconds and the measuring is performed once. As a result, it was recognized that there was no electrostatic aggregation in the lubricant agent 11 in which the reduction-processed type tin oxide particles having resistance not more than 105 cm and Tospearl particles were dispersed.

D10, D50, and D90 of the lubricant agent 11 in which the reduction-processed type tin oxide particles having resistance not more than $10^5$ Ωcm and Tospearl particles, respectively are 0.39 to 0.45 μm, 0.51 to 0.58 μm, and 0.67 to 0.77 μm.

Hereinafter, a description will be provided about resistance of the reduction-processed type tin oxide particles.

Note that the resistance of particles is measured as discussed below.

A cylindrical metallic cell is filled with a sample. Next, electrodes are arranged above and below the sample so as to contact the sample. A load of 686 kPa (7 kgf/cm2) is added onto the above electrode. In this condition, a voltage V is applied between the upper and lower electrodes. The resistance (volume resistivity RV) relating to the present invention is measured from the current I (A) that flows at this time. Then, if an electrode area and the sample thickness are respectively defined by S ($cm^2$) and M (cm), following equation is satisfied:

$$RV(\Omega cm)=100V \text{ multiplied by } S(cm^2)/I(a)/M(cm)$$

In the present embodiment, under a condition that a contact area between one of the electrodes and the sample is 2.26 $cm^2$ and the voltage V=100 V, the measurement is carried out.

As shown in FIG. 7, in the reduction-processed type tin oxide particles having a resistance not less than $10^5$ Ωcm, the adhesive strength was not enhanced. Therefore it is indispensable to form low resistance in order to enhance adhesive strength.

Accordingly, as apparent from FIG. 4 and FIG. 7, it is optimal that the resistance of reduction-processed type tin oxide particles is not more than $10^5$ Ωcm.

As above-explained, in the present invention, it can be prevented that the cleaning blade is detached by the motion of the electrophotographic photosensitive body. Also, it can be prevented that an electrophotographic photosensitive body is insufficiently charged by the charging roller by coating insulating particles on the abutment portion that abuts the electrophotographic photosensitive body. Also, it is possible to enhance adhesiveness between the cleaning blade and the insulating particles that are coated on an abutment portion of the cleaning blade where the abutment portion is a portion that abuts the electrophotographic photosensitive body.

What is claimed is:

1. A cleaning blade for removing remaining developer on an electrophotographic photosensitive body usable by an image forming apparatus comprising:

an abutment portion abutable to the electrophotographic photosensitive body; and lubricant including:

insulating particles; and conductive particles wherein said lubricant coats said abutment portion, wherein the median volume-based particle size, D50, of each of said insulating particles lies in a range of 0.2 to 1.0 μm and the median volume-based particle size, D50, of each of said conductive particles lies in a range of 0.4 to 4.0 μm, and wherein the median volume-based particle size, D50, of each of said conductive particles lies in a range that is larger than the range of the median volume-based particle size, D50, of each of said insulating particles.

2. The cleaning blade as recited in claim 1, wherein said insulating particles are composed of silicone resin powder.

3. The cleaning blade as recited in claim 1 or 2, wherein said conductive particles are composed of reduction-processed type tin oxide.

4. The cleaning blade as recited in claim 1, wherein said conductive particles are hydrophobically processed.

5. The cleaning blade as recited in claim 1, wherein the median volume-based particle size, D50, of said insulating particles lies in a range of 0.6 to 0.8 μm, while the median volume-based particle size, D50, of said conductive particles lies in a range of 1.0 to 2.0 μm.

6. The cleaning blade as recited in claim 1, wherein the volume resistivity of said conductive particles is not more than $10^5$ Ωcm, and the weight of said conductive particles is 20 to 80% relative to the total weight of said lubricant.

7. The cleaning blade as recited in claim 6, wherein the weight of said conductive particles is 20 to 50% of the total weight of said lubricant.

8. A cleaning device usable by an image forming apparatus comprising:

a cleaning blade configured and positionable to remove a remaining developer on an electrophotographic photosensitive body;

an abutment portion abutable to the electrophotographic photosensitive body; and lubricant including:

insulating particles; and conductive particles coated on said abutment portion, wherein the median volume-based particle size, D50, of each of said insulating particles lies in a range of 0.2 to 1.0 μm and the median volume-based particle size, D50, of each of said conductive particles lies in a range of 0.4 to 4.0 μm, and wherein the median volume-based particle size, D50, of each of said conductive particles lies in a range that is larger than the range of the median volume-based particle size, D50, of each of said insulating particles.

9. The cleaning device as recited in claim 8, wherein said insulating particles are composed of silicone resin powder.

10. The cleaning device as recited in claim 8 or 9, wherein said conductive particles are composed of reduction-processed type tin oxide.

11. The cleaning device as recited in claim 8, wherein said conductive particles are hydrophobically processed.

12. The cleaning device as recited in claim 8, wherein the median volume-based particle size, D50, of said insulating particles lies in a range of 0.6 to 0.8 μm, while the median volume-based particle size, D50, of said conductive particles lies in a range of 1.0 to 2.0 μm.

13. The cleaning device as recited in claim 8, wherein the volume resistivity of said conductive particles is not more than $10^5$ Ωcm, and the weight of said conductive particles is 20 to 80% of the total weight of said lubricant.

14. The cleaning device as recited in claim 13, wherein the weight of said conductive particles is 20 to 50% of the total weight of said lubricant.

15. A process cartridge attachable to a body of an image forming apparatus comprising:

an electrophotographic photosensitive body;

a charging device configured and positioned to charge said electrophotographic photosensitive body;

a cleaning blade configured and positioned to remove a remaining developer on said electrophotographic photosensitive body;

an abutment portion abutable on said electrophotographic photosensitive body; and lubricant including:

insulating particles; and conductive particles coated on said abutment portion, wherein the median volume-based particle size, D50, of each of said insulating particles lies in a range of 0.2 to 1.0 μm and the median volume-based particle size, D50, of each of said conductive particles at D50 lies in a range of 0.4 to 4.0 μm, and wherein the median volume-based particle size, D50, of each of said conductive particles lies in a range that is larger than the range of the median volume-based particle size, D50, of each of said insulating particles.

16. The process cartridge as recited in claim 15, wherein said insulating particles are composed of silicone resin powder.

17. The process cartridge as recited in claim 15 or 16, wherein said conductive particles are composed of reduction-processed type tin oxide.

18. The process cartridge as recited in claim 15, wherein said conductive particles are hydrophobically processed.

19. The process cartridge as recited in claim 15, wherein the median volume-based particle size, D50, of said insulating particles lies in a range of 0.6 to 0.8 $\mu$m, while the median volume-based particle size, D50, of said conductive particles lies in a range of 1.0 to 2.0 $\mu$m.

20. The process cartridge as recited in claim 15, wherein the volume resistivity of said conductive particles is not more than $10^5$ Ωcm, and the weight of said conductive particles is 20 to 80% of the total weight of said lubricant.

21. The process cartridge as recited in claim 20, wherein the weight of said conductive particles is 20 to 50% of the total weight of said lubricant.

22. An image forming apparatus for forming an image on a recording medium comprising:

(i) a cleaning device usable by said image forming apparatus comprising:

a cleaning blade configured and positioned to remove a remaining developer on an electrophotographic photosensitive body;

an abutment portion that abuts the electrophotographic photosensitive body; and lubricant including:

insulating particles; and conductive particles coated on said abutment portion, wherein the median volume-based particle size, D50, of each of said insulating particles lies in a range of 0.2 to 1.0 $\mu$m and the median volume-based particle size, D50, of each of said conductive particles lies in a range of 0.4 to 4.0 $\mu$m, wherein the median volume-based particle size, D50, of each of said conductive particles lies in a range that is larger than the range of the median volume-based particle size, D50, of each of said insulating particles; and (ii) a carrying means for carrying the recording medium.

23. An image formation apparatus for forming an image onto a recording medium comprising:

(i) an attachment portion detachably attached to a process cartridge;

(ii) said process cartridge attached to said attachment portion, said process cartridge including:

an electrophotographic photosensitive body;

a charging device configured and positioned to charge said electrophotographic photosensitive body;

a cleaning blade configured and positioned to remove a remaining developer on said electrophotographic photosensitive body;

an abutment portion configured and positioned to abut said electrophotographic photosensitive body; and lubricant including:

insulating particles; and conductive particles being coated on said abutment portion, wherein the median volume-based particle size, D50, of each of said insulating particles lies in a range of 0.2 to 1.0 $\mu$m and the median volume-based particle size, D50, of each of said conductive particles lies in a range of 0.4 to 4.0 $\mu$m, wherein the median volume-based particle size, D50, of each of said conductive particles lies in a range that is larger than the range of the median volume-based particle size, D50, of each of said insulating particles; and (iii) carrying means for carrying the recording medium.

* * * * *

UNITED STATES PATENT AND TRADEMARK OFFICE

CERTIFICATE OF CORRECTION

PATENT NO. : 6,983,120 B2
APPLICATION NO. : 10/765856
DATED : January 3, 2006
INVENTOR(S) : Yasuyuki Ishii et al.

It is certified that error appears in the above-identified patent and that said Letters Patent is hereby corrected as shown below:

IN THE DRAWINGS
Sheet 4, Figure 4, “DETATCHMENT” should read --DETACHMENT--.
Sheet 7, Figure 7, “DETATCHMENT” should read --DETACHMENT--.

COLUMN 1
Line 54, “not” should read --has not--.

COLUMN 2
Line 17, “power,” should read --powder,--.
Line 18, “produced” should read --(produced--.
Line 60, “that” should be deleted.

COLUMN 3
Line 38, “4.0 m” should read --4.0 μm--.

COLUMN 5
Line 62, “become” should read --becomes--.
Line 64, “a” should read --in a--.

COLUMN 6
Line 18, “titan” should read --titanium--.

COLUMN 7
Line 17, “are” should read --is--.
Line 56, “v” should read --V--.
Line 63, “105 cm” should read --$10^5$ Ωcm--; and “with” should be deleted.

UNITED STATES PATENT AND TRADEMARK OFFICE

CERTIFICATE OF CORRECTION

PATENT NO. : 6,983,120 B2
APPLICATION NO. : 10/765856
DATED : January 3, 2006
INVENTOR(S) : Yasuyuki Ishii et al.

It is certified that error appears in the above-identified patent and that said Letters Patent is hereby corrected as shown below:

COLUMN 8
Line 49, "105 cm" should read --$10^5$ Ωcm--.

Signed and Sealed this

Fifteenth Day of August, 2006

JON W. DUDAS
*Director of the United States Patent and Trademark Office*